United States Patent [19]

Herten et al.

[11] Patent Number: 4,541,558

[45] Date of Patent: Sep. 17, 1985

[54] RIVETING PRESS SAFETY

[75] Inventors: Ernst Herten; Eilhelm Eiringhaus, both of Stolberg, Fed. Rep. of Germany

[73] Assignee: William Prym-Werke Kg, Stolberg, Fed. Rep. of Germany

[21] Appl. No.: 599,172

[22] Filed: Apr. 11, 1984

[30] Foreign Application Priority Data

Apr. 13, 1983 [DE] Fed. Rep. of Germany ..... 3313351

[51] Int. Cl.[4] ..... B21J 15/28

[52] U.S. Cl. ..... 227/1; 227/7; 227/61; 227/124

[58] Field of Search ..... 227/1, 7, 8, 51, 53, 227/55, 56, 61, 62, 124, 142, 151, 154, 155; 266/76

[56] References Cited

U.S. PATENT DOCUMENTS

| | | | |
|---|---|---|---|
| 2,199,286 | 4/1940 | Fisher | 227/1 |
| 4,013,277 | 3/1977 | Schmitt | 266/76 |
| 4,052,040 | 10/1977 | Ogden | 266/76 X |
| 4,343,423 | 8/1982 | Sauermilch | 227/1 |

FOREIGN PATENT DOCUMENTS

| | | | |
|---|---|---|---|
| 2556516 | 6/1977 | Fed. Rep. of Germany | 227/1 |
| 2915328 | 10/1980 | Fed. Rep. of Germany | 227/1 |
| 546098 | 6/1942 | United Kingdom | 226/76 |

*Primary Examiner*—Paul A. Bell
*Attorney, Agent, or Firm*—Peter K. Kontler

[57] ABSTRACT

A riveting press wherein a stationary lower tool is in line with a vertically reciprocable upper tool which is moved up and down in response to rotation of a first cam mounted on the output shaft of an electric motor. The output shaft carries a second cam with an endless cam groove for the follower at the upper end of a first elongated bar which is coupled to the upper portion of a second elongated bar with limited freedom of reciprocatory movement. The lower portion of the second bar carries a pair of grippers which can releasably hold a component of an article of hardware to be affixed to a sheet of textile material between the two tools. A coil spring biases the two bars apart so as to increase the distance between the follower and the grippers and to thereby close an electric switch which is in circuit with the motor. If the grippers encounter an obstruction on their way toward the sheet on or adjacent to the lower tool, the switch opens because the upper bar moves downwardly relative to the lower bar and the motor is arrested. The groove of the second cam has a portion of greater width to allow for movement of the follower in such portion of the groove in the radial direction of the second cam. This enables the press to apply components of articles of hardware to thicker or thinner workpieces.

17 Claims, 5 Drawing Figures

RIVETING PRESS SAFETY

BACKGROUND OF THE INVENTION

The present invention relates to machines for applying components of articles of hardware to sheet- or web-like workpieces, e.g., for applying rivets or like articles to jeans, jackets or other garments. Typical examples of such machines are riveting presses wherein a stationary lower tool is disposed in register with a vertically reciprocable upper tool. A component of an article of hardware, which is placed between one of the tools and a workpiece which is also disposed between the tools is automatically attached to the workpiece when the reciprocable tool descends. If the article of hardware comprises two components which must be attached to one another as well as to the workpiece, one of the components is placed onto the lower tool below the workpiece and the other component is placed in front of the descending upper tool at a lever above the workpiece so that one of the components penetrates through the workpiece and is attached to the other component in response to last stage of downward movement of the upper tool.

As a rule, the component which is placed in front of the descending upper tool is held by suitable grippers which are movable up and down with and relative to the upper tool. The upper tool is reciprocated by a rotary cam, and a discrete second cam can be provided to move the grippers toward and away from the upper side of the workpiece, not unlike the hold-down device in a sewing machine is movable relative to the needle.

German Offenlegungsschrift No. 29 15 328 discloses a riveting press wherein the grippers receive motion from their cam by way of two motion transmitting members which are movable relative to one another and constitute elements of a safety device serving to prevent injury to a careless or inexperienced operator. The upper motion transmitting member carries at its upper end a follower for the respective cam and the lower motion transmitting member carries the grippers at its lower end. The electric motor which drives the cam for the grippers is arrested in response to opening of an electric switch whose contacts are mounted on the two motion transmitting members in such a way that the switch opens in automatic response to shifting of the upper member relative to the lower member when the grippers on the lower member encounter an obstruction (e.g., one or more fingers) on their way toward the upper side of the workpiece between the two tools. A spring biases the motion transmitting members in a direction to increase the distance between the follower on the upper member and the grippers on the lower member, and such spring yields when the downward movement of the lower member is terminated prematurely by an obstruction in the path of downward movement of the grippers. The roller follower of the upper motion transmitting member extends into an endless groove of the respective cam so that it is compelled to move between predetermined upper and lower end positions in response to each revolution of the cam. This ensures that the upper member moves relative to the lower member, against the opposition of the aforementioned spring, when the lower member and its grippers are held against further or any downward movement with the upper member due to the presence of an obstruction in the path of movement of the grippers toward the upper side of the workpiece.

The aforementioned German printed publication further discloses an auxiliary cam which is designed to engage the lower motion transmitting member when the latter approaches or reaches the lower end of its downward stroke to thus hold the lower member in the lower end position. This auxiliary cam is intended to prevent unintentional opening of the switch in the circuit of the electric motor under the action of a compressed workpiece which tends to expand and to move the grippers and the lower motion transmitting member upwardly which, in the absence of the auxiliary cam, would result in immediate stoppage of the motor as a consequence of movement of the upper member relative to the lower member. The provision of auxiliary cam contributes to the complexity, cost and bulk of the press which is disclosed in the German printed publication. Moreover, the provision of the auxiliary cam reduces the versatility of the press because it limits the extent to which the thicknesses of the workpieces to be treated in the machine can deviate from an optimum or average thickness. In other words, if a workpiece is relatively thick, the lower motion transmitting member cannot reach that (lower end) position in which it can be engaged and held by the auxiliary cam unless it is urged downwardly with a force which is likely to cause breakage of machine parts and/or permanent damage to a relatively thick workpiece. On the other hand, pronounced versatility of a riveting press is often not only desirable but absolutely necessary, e.g., when the machine is to apply components of articles of hardware to portions of garments (such as jeans or jackets) wherein one or more first articles of hardware must be applied to a single layer of textile material but one or more second articles of hardware must be applied to a portion of a garment which consists of a substantial number of layers so that its thickness is a multiple of the thickness of a single layer. It is not unusual to apply articles of metallic or plastic hardware to a piece of garment which consists of as many as six or even more layers. The aforediscussed riveting press which is disclosed in the German printed publication does not exhibit the required versatility for such types of operations, except if one would discard the safety feature which is unacceptable to most manufacturers for obvious reasons.

OBJECTS AND SUMMARY OF THE INVENTION

An object of the invention is to provide a novel and improved machine which can be used for the application of components of articles of hardware or the like to workpieces whose thickness can vary within a desired range.

Another object of the invention is to provide a machine, such as a riveting press, which can shift from the application of components of articles of hardware or the like to relatively thin workpieces to the application of such or other types of components to relatively thick workpieces or vice versa without any adjustments and hence without any interruptions for the purpose of carrying out such adjustments.

A further object of the invention is to provide a machine wherein the aforementioned versatility is achieved without increasing its bulk, complexity and/or cost.

An additional object of the invention is to provide a novel and improved method of ensuring automatic conversion of a riveting press or an analogous machine for the application of articles of hardware or the like to thin, medium thick or even very thick workpieces without in any way affecting the sensitivity and reliability of the aforediscussed safety feature or features.

Still another object of the invention is to provide a machine wherein the quality of applied articles and/or the reliability of attachment of such articles is not adversely affected by the thickness of the workpieces.

A further object of the invention is to provide a riveting press or an analogous machine with novel and improved means for transmitting motion to the means for holding components of articles of hardware or the like in the path of movement of the tool which is used to apply such components to complementary components as well as to thin, medium thick or very thick workpieces consisting of textile, metallic, synthetic plastic and/or other sheet material.

Still another object of the invention is to provide a novel and improved cam for use in the above outlined machine and to provide novel and improved means for transmitting motion from such cam to the means for holding components of articles of hardware or the like in the path of movement of a reciprocable riveting tool.

The invention is embodies in a machine for applying components or articles of hardware or the like to sheet- or web-like workpieces, especially for applying components of relatively small articles of metallic or plastic hardware to webs or sheets of textile or other penetrable flexible material. The machine comprises a first tool which is or can be fixedly mounted in a frame, a second tool which is movable toward the first tool from a retracted position in which the tools define a space for a workpiece therebetween (for example, the second tool can be reciprocated between a raised position at a maximum distance and a lowered position at a minimum distance from the first tool), first drive means for reciprocating the second tool from and back to its retracted position, and means for releasably holding a component of an article of hardware or the like between the workpiece in the aforementioned space and the second tool. Such holding means is movable with and relative to the second tool between a first position in which the holding means is remote from the first tool and several second positions in which the holding means is nearer to the first tool. The machine further comprises second drive means for moving the holding means between the first and second positions, and such second drive means includes a rotary cam defining an endless path (e.g., an endless groove in one side face of a disc-shaped cam), a first reciprocable motion transmitting member having a follower which extends into the path, a second motion transmitting member which is connected with the holding means, one or more pin-and-slot connections or other suitable means for coupling the motion transmitting members to each other with limited freedom of movement, a coil spring or other suitable means for yieldably biasing the motion transmitting members in directions to increase the distance between the follower and the holding means (i.e., to increase the combined length of the motion transmitting members if the follower is mounted at the upper end of the first member and the holding means is mounted at the lower end of the second member), a prime mover which is operable to rotate the cam, and a device for preventing the operation of the prime mover in response to movement of one of the motion transmitting members relative to the other motion transmitting member against the opposition of the biasing means when the holding means encounters an obstruction or obstacle on its way from the first to a second position (preferably during the first stage of movement of the holding means from its first position). The aforementioned path has a portion which allows the follower of the first motion transmitting member to move radially of the cam in that angular position of the cam when the holding means is at least close to a second position. This renders it possible to account for differences between the thicknesses of workpieces without causing stoppage of the prime mover, i.e., without causing one of the motion transmitting members to move relative to the other member and to actuate the preventing device.

If the prime mover includes an electric motor, the preventing device includes or can include an electric switch which is in circuit with the motor and is closed when the biasing means is free to maintain the follower at a maximum distance from the holding means.

As mentioned above, the cam is preferably provided with an endless cam groove which defines the path for the follower and is flanked at the inside by an endless first or inner surface and at the outside by an endless second or outer surface. These surfaces are or can be generally equidistant from each other save for those portions of such surfaces which flank the aforementioned radially enlarged portion of the endless path. The cam then preferably comprises a recess (e.g., a substantially crescent-shaped cutout) which is provided in the outer surface in the region of the aforementioned portion of the path. Such recess enables the follower to move radially of the cam and to thus account for differences between the thicknesses of the workpieces which are placed seriatim into the space between the first tool on the one hand and the holding means and the second tool on the other hand.

The coupling means includes means (e.g., the aforementioned pin-and-slot connection or connections) for limiting the extent of movement of the motion transmitting members relative to each other. Still further, the machine preferably comprises a second coil spring or other suitable means for yieldably urging the first motion transmitting member in a sense to move the first member in a direction toward the first tool, i.e., to urge the follower against the inner surface of the cam.

The machine preferably further comprises a platform or other suitable work supporting means which is adjacent to the first tool and is movable between retracted and extended positions in which such supporting means is respectively located at a greater distance from and is nearer to the second tool. Such machine then further comprises resilient means (e.g., one or more third coil springs) for yieldably urging the supporting means to its extended position. The force of the biasing means exceeds the force of such resilient means so that the holding means can move the supporting means to the retracted position in response to movement of the holding means to a second position. The supporting means (e.g., the aforementioned platform) is preferably provided with a preferably horizontal or nearly horizontal work supporting surface which has a passage for the first tool so that the platform can move relative to the first tool. Means can be provided for arresting the platform against movement beyond the extended position and/or against movement from the extended back to the retracted position.

The aforementioned means for urging the first motion transmitting member in a direction toward the first tool is preferably weaker than the biasing means so that the preventing device is not actuated when the follower is caused to move in the enlarged portion of its path radially of the cam as a result of the placing of a relatively thick workpiece between the two tools.

The holding means can comprise a plurality of grippers which define a socket for a component of an article of hardware or the like and serve to bear against the workpiece in the aforementioned space in the second position of the holding means. The first tool is preferably disposed at a level below the second tool and the first drive means preferably receives motion from the prime mover. To this end, the first drive means can comprise a second rotary cam which is mounted on the output shaft of the prime mover, the same as the cam of the second drive means. The motion transmitting members can constitute two parallel elongated bars or rods.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
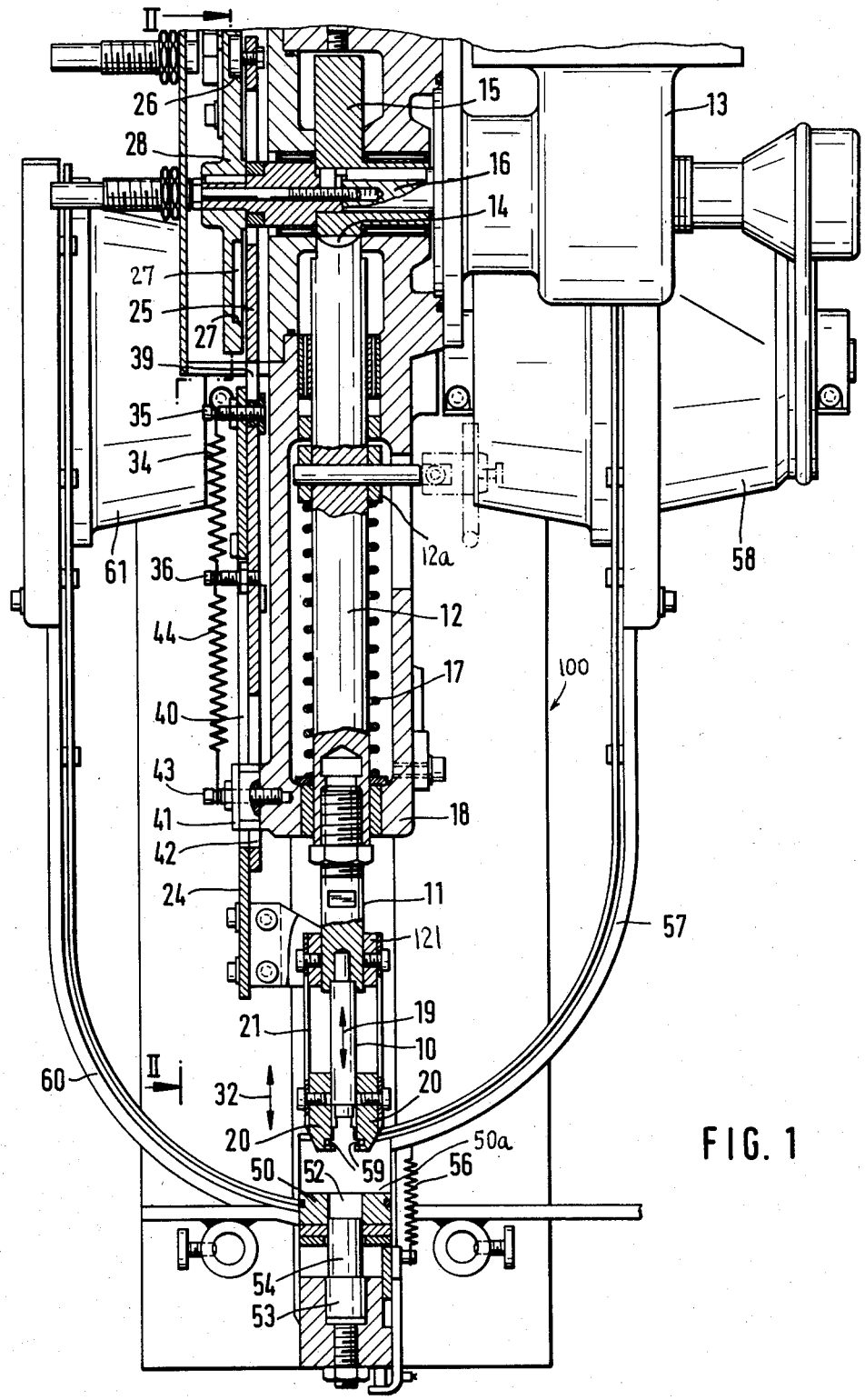
FIG. 1 is a partly front elevational and partly vertical sectional view of a riveting press which embodies the invention.

The machine which is shown in FIG. 1 is a riveting press. However, the invention can be embodied with equal or similar advantage in many other types of machines which can be used to provide workpieces (e.g., sheets, strips or webs made of one or more layers of textile material, one or more layers of metallic or plastic foil, cardboard or even paper) with components of metallic or plastic articles of hardware including rivets, eyelets, hooks, buttons, clamps, snap fasteners and many others. The operation which can be carried out in such machines for the purpose of attaching components of articles of hardware to workpieces can involve hammering, upsetting, bending, punching, forging, expanding and other deforming operations. For example, the machine which embodies the invention can be used to apply a single component at a time and to simultaneously change the shape of the applied component so that it constitutes a one-piece article of hardware which, as a result of the shaping operation, is also permanently or detachably secured to a workpiece, e.g., to a web or sheet of textile material which can be converted into, or already constitutes, jeans, a jacket or the like. Alternatively, the machine can be used to attach two components to each other simultaneously with penetration of a portion of one of the components through a workpiece. One of these components can constitute a rivet having a head and a shank which latter is caused to penetrate first through a workpiece and thereupon into a washer or a cap. In all or nearly all instances, the components of articles of hardware which are being applied and assembled are designed to penetrate through the material of a textile or a like workpiece, i.e., the latter need not be provided with prefabricated holes for such components.

The machine of FIG. 1 comprises a stationary upright frame 100 supporting a vertically movable upper tool 10 (hereinafter called ram) which is aligned with a stationary lower tool 54 secured to a base 53 in the lower portion of the frame 100. Still further, the machine comprises means for releasably holding a component of an article of hardware at a level below the mobile ram 10 so that the latter can attach such component to a complementary component resting on the top surface of the lower tool 54. At the same time, the component which is being moved downwardly by the ram 10 and/or the component which is supported by the tool 54 is caused to penetrate through the material of a workpiece 51 (FIG. 4) or 51' (FIG. 5) which is placed into the space between the tool 54 and the ram 10. The holding means includes two grippers or jaws 20 which flank the ram 10 and are movable up and down, toward and away from the workpiece 51 or 51', with as well as relative to the ram 10. The inner sides of the grippers 20 (namely those sides which face one another) are formed with recesses 59 which together constitute a socket capable of accepting and releasably holding a component of an article of hardware while the grippers move from a first or retracted or idle position (shown in FIG. 1) to a second or extended or operative position in which they bear against the workpiece 51 or 51' and, at the same time, maintain a component in their socket 59 in an optimum position for attachment to a component on the top surface of the stationary tool 54.

Figure 3:
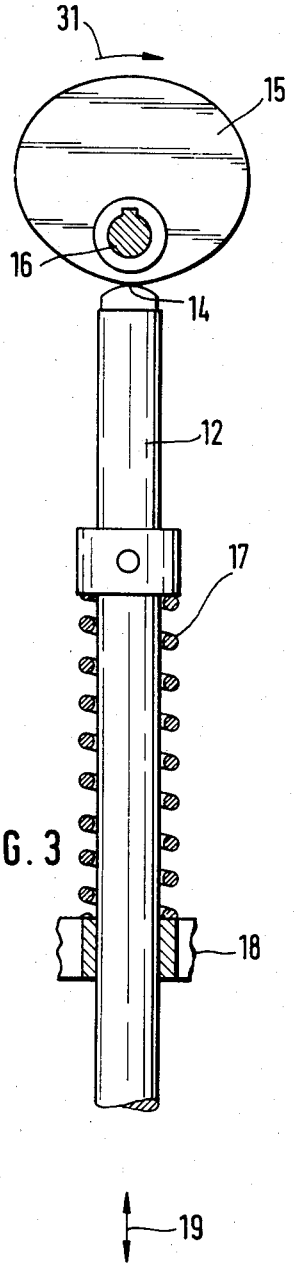
FIG. 3 is a fragmentary side elevational view of the means for reciprocating the upper tool.

The upper portion of the ram 10 is connected with a vertically reciprocable plunger 12 by an adapter 11. The plunger 12 and the adapter 11 constitute elements of a first drive means which causes the ram 10 to move downwardly from a retracted position (shown in FIGS. 1 and 3) and back to such retracted position. The first drive means further comprises a rotary disc-shaped cam 15 which is mounted on the horizontal output shaft 16 of a prime mover 13 in the form of an electric motor mounted in or on the upper portion of the frame 100. The upper end portion of the plunger 12 constitutes or carries a follower 14 which tracks the peripheral surface of the cam 15. A coil spring 17 reacts against a stationary frame member 18 and bears against the underside of a sleeve **12*a* on the plunger 12 to urge the latter upwardly and to thus maintain the follower 14 in permanent contact with the peripheral surface of the cam 15. The directions in which the ram 10 can be reciprocated by the cam 15 in conjunction with the coil spring 17 are indicated by a double-headed arrow 19**.

The machine comprises a second drive means which includes the aforementioned motor 13 and serves to reciprocate the grippers 20 of the holding means between their raised (idle) and lowered (second) positions. Such second drive means further comprises two leaf springs 21 which couple the respective grippers 20 to a head 121. The latter is connected to the lower end portion of an elongated bar-shaped motion transmitting member 24 whose upper portion is coupled to a similar motion transmitting member 25. The upper end portion of the member 25 carries a roller follower 26 which extends into an endless path or groove 27 machined in one side face of a rotary cam 28 fixedly mounted on the output shaft 14 of the electric motor 13. The groove 27 is surrounded by an endless outer surface 23 and surrounds an endless inner surface 22 of the cam 28 (see FIGS. 2, 4 and 5). The width of the major part of the groove 27 (as considered in the radial direction of the cam 28) is constant or practically constant and only slightly exceeds the diameter of the roller follower 26 so that the latter is positively connected to this cam but the latter can rotate with the shaft 14 in order to move the members 24 and 25 (and hence the grippers 20) up and down. However, the cam 28 further comprises an arcuate crescent-shaped recess 33 which is machined into the outer surface 23 in the region which is tracked by the roller follower 26 when the grippers 20 approach and are located in their second (lower end) positions. The purpose of the recess 33 (i.e., of the radially enlarged portion of the endless cam groove 27) will be explained with reference to FIGS. 4 and 5. The width of the portion 29 of the groove 27 is constant or nearly constant but the configuration of this portion of the groove is such that the cam 28 moves the motion transmitting members 25, 24 downwardly and thereupon maintains the member 25 at a constant distance from the axis of the shaft 16 while the roller follower 26 tracks the portion 29. It is assumed that the motor 13 drives the shaft 16 in a sense to rotate the cams 15 and 28 in a clockwise direction as indicated by the arrows 31 shown in the upper portions of FIGS. 3 and 2. The directions in which the cam 28 can reciprocate the motion-transmitting members 24, 25 and the grippers 20 are indicated by a double-headed arrow 32. The reference character 30 denotes in FIG. 2 a portion of the groove 27 wherein the roller follower 26 is confined while the grippers 20 are held in their second or lower end positions at a maximum distance from the axis of the shaft 16, i.e., the roller follower 26 is then located at a minimum distance from such axis (it must be borne in mind that, in the illustrated embodiment, the roller follower 26 is always located at a level above the shaft 16). The portion 30 of the groove 27 includes a part of the aforementioned crescent-shaped recess 33 in the outer surface 23 of the cam 28.

The grippers 20 and the motion transmitting members 24, 25 constitute elements of a safety device which prevents operation of the electric motor 13 when an obstruction of certain height is located between the undersides of the grippers and the workpiece 51 or 51'. The grippers 20 can be said to constitute the sensors of such safety device because they resist further downward movement of the motion transmitting member 24 when they detect an obstruction between their undersides and the workpiece above the lower tool 54. The safety device further comprises a normally closed electric safety switch which is in circuit with the motor 13 and includes a first electric contact 37 on the motion transmitting member 24 and a second electric contact 38 on the motion transmitting member 25. The latter is movable within limits relative to the member 24 to thereby move its contact 38 downwardly and away from the contact 37 on the member 24 when the latter is prevented from sharing the downward movement of the member 25 because the grippers 20 have encountered an obstruction of excessive height. A coil spring 34 constitutes a means for biasing the members 24, 25 in directions to increase the distance between the grippers 20 and the roller follower 26 and to thus maintain the lower contact 38 in engagement with the upper contact 37, i.e., to complete the circuit of the motor 13. A vertical slot 39 in the motion transmitting member 25 receives a portion of a post 35 which is anchored in the upper portion of the motion transmitting member 24 and is connected with the upper portion of the spring 34. The lower portion of the spring 34 is attached to a second post 36 which is anchored in the lower portion of the member 25 and extends through a vertical slot 40 of the member 24. Thus, when the spring 34 is free to contract (to the extent determined by the length of the slot 39 in the member 25), the post 35 extends into the lowermost portion of the slot 39 and the post 36 extends into the uppermost portion of the slot 40 with the result that the combined length of the members 24, 25 reaches its maximum value and the safety switch including the contacts 37, 38 is closed. The post 36 is preferably surrounded by a suitable ring-shaped or washer-like bearing member which is slidable in the slot 40 of the member 24 with no wobbling at all or with minimal lateral play.

The slot 40 further receives an extension 41 of the frame member 18 which extension also extends through a second elongated slot 42 in the lower portion of the motion transmitting member 25. The extension 41 carries a horizontal post or stud 43 which is attached to the lower end portion of a second coil spring 44 constituting a means for permanently urging the upper motion transmitting member 25 downwardly with a force which is less than the force of the spring 34. To this end, the upper end portion of the coil spring 44 is connected to the post 36 which is anchored in the motion transmitting member 25 and extends through the slot 40 of the motion transmitting member 24 at a level above the extension 41. The purpose of the coil spring 44 is to ensure that the roller follower 26 at the upper end of the motion transmitting member 25 is normally in contact with the inner surface 22 of the cam 28. This applies for all angular positions of the cam 28, i.e., also when the roller follower 26 is adjacent to the crescent-shaped recess 33 in the outer surface 23 of the cam 28.

The means for supporting a workpiece 51 or 51' at a level above the lower tool 54 comprises a platform 50 having a horizontal top surface 50*a* for the underside of a selected portion of the workpiece 51 or 51', namely that portion of the workpiece which is to be provided with an article of hardware. The difference between the workpieces 51 and 51' is that the latter is much thicker so that it prevents the grippers 20 from coming as close to the top surface 50*a* of the platform 50 as when the surface 50*a* supports the workpiece 51. For example, the workpiece 51 can consist of a single layer of textile material whereas the workpiece 51' can comprise a substantial number of such layers. As mentioned above, the workpiece which is to be provided with an article of hardware in the space between the stationary tool 54 and the vertically reciprocable ram 10 can also comprise one or more layers or foils of metallic or synthetic plastic material, cardboard, paper or a combination of two or more layers consisting of different materials.

The top surface 50*a* of the platform 50 is formed with a vertical passage 52 for the fixed tool 54. One or more coil springs 56 or other suitable biasing means are provided to urge the platform 50 upwardly and against one or more fixed stops (not specifically shown) in or on the frame 100. The platform 50 can be temporarily locked in the upper end position so as to facilitate the placing of a selected portion of the workpiece 51 or 51' into the space between the tool 54 and the ram 10. For example, the arrangement may be such that the platform 50 is locked in the upper end position until after the safety device including the grippers 20 and the switch 37, 38 completes its monitoring operation to ascertain whether or not an obstruction of excessive height is located in the path of downward movement of the grippers 20 toward the workpiece 51 or 51' on the surface 50*a* of the platform 50. Once the locking means for the platform 50 is disengaged or deactivated, the platform can be pushed downwardly against the opposition of the coil spring or springs 56. The arrow 55 indicates in FIG. 2 the directions of reciprocatory movements of the platform 50 between its upper and lower end positions. The means for pushing the platform 50 downwardly from the upper end position of FIG. 1 are the grippers 20 which can shift the platform against the opposition of the coil spring or springs 56 through the medium of the workpiece 51 or 51' on the top surface 50*a*.

The frame 100 supports two magazines 58, 61 which are respectively connected with chutes 57, 60. The magazine 58 stores a supply of components which are delivered into the socket 59 of the grippers 20 by way of the chute 57 in such orientation that the components are ready for attachment to the workpiece 51 or 51' as well as to complementary components in the passage 52 of the platform 50. Analogously, the magazine 61 stores components each of which is delivered to the passage 52 by way of the chute 60 in proper orientation for attachment to a workpiece 51 or 51' as well as to the component which is then held in the socket 59. The magazines 58 and 61 contain or are combined with suitable orientation changing and maintaining means which ensure that each and every component which enters the respective chute 57, 60 is in proper orientation for application to a workpiece and to the complementary component. Such orientation maintaining and changing devices are well known in the relevant arts, e.g., in the field of bottle capping machines. The last stage of movement of each component from the discharge end of the chute 57 to the sockets 59 is effected by a reciprocable pusher which is not specifically shown in the drawing. Reference may be had to the commonly owned copending patent application Ser. No. 598,990 filed Apr. 11, 1984 by Paul Hagmann for "Apparatus for feeding articles of hardware in riveting presses and the like". A similar pusher is preferably provided between the discharge end of the chute 60 and the passage 52 above the lower tool 54.

Figure 2:
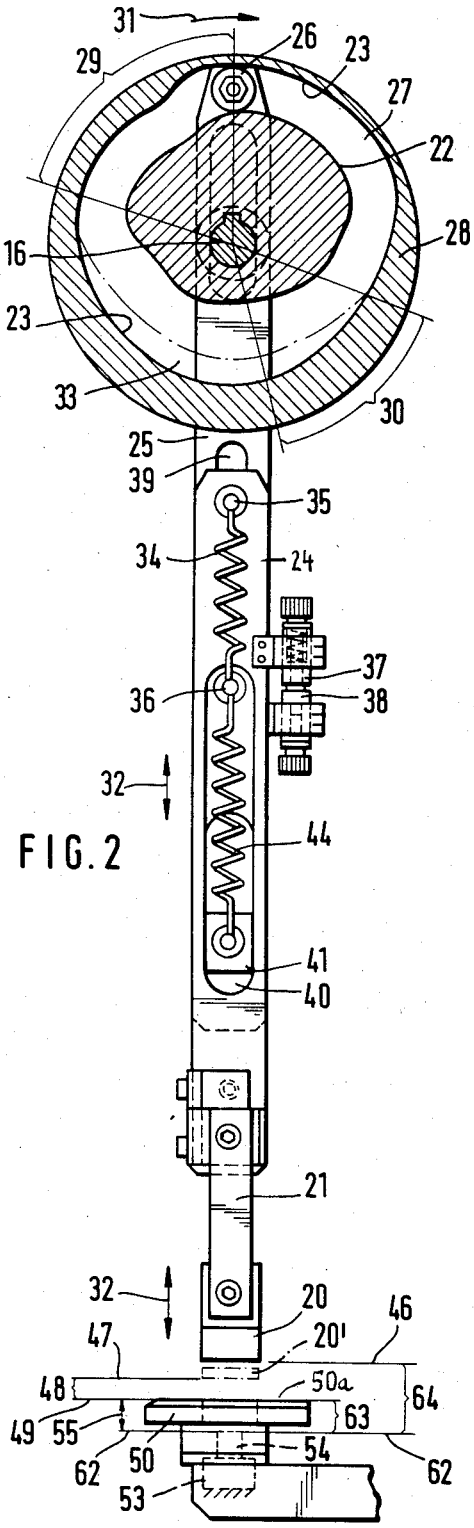
FIG. 2 is a partly side elevational and partly vertical sectional view of the drive means for the work engaging device as seen in the direction of arrows from the line II—II of FIG. 1.

The mode of operation of the improved machine is as follows:

FIG. 2 shows the cam 28 of the drive means for the grippers 20 of the holding means in its starting position, i.e., in the position the cam assumes prior to start of a working cycle. The cam 15 of the drive means for the ram 10 then assumes the angular position of FIG. 3. The motion transmitting members 24, 25 maintain the grippers 20 in their upper end positions in which the undersides of the grippers 20 are disposed at the level 46 shown in FIG. 2. When the motor 13 is started and the cam 28 completes an angular movement through 75 degrees in a clockwise direction as indicated in FIG. 2 by the arrow 31, the roller follower 26 of the upper motion transmitting member 25 is located at the end of the portion 29 of the cam groove 27. As mentioned above, the centers of curvature of those portions of the surfaces 22, 23 which bound the rear part of the portion 29 of the groove are located on the axis of the shaft 16 so that the distance between the axis of the shaft 16 and the grippers 20 remains at least substantially unchanged while the roller follower 26 is received in the second half of the portion 29, as viewed in the direction of arrow 31. The grippers 20 are then located in the phantom-line positions 20' of FIG. 2, i.e., their undersides are disposed at the level 47. At such time, the undersides of the grippers 20 are disposed for a certain interval of time at a safety distance 48 from the top surface 50*a* of the platform 50. The interval is needed to enable the grippers 20 to ascertain whether or not the space between their undersides and the platform 50 is free of obstacles, such as one or more fingers of the attendant. The platform 50 is then locked in its upper end position in which the top surface 50*a* is located at the level 49 shown in FIG. 2.

If an obstacle is detected by the grippers 20 in the space 48 between the lines 47 and 49, and the height of such obstacle exceeds the height of the space 48, the grippers 20 cannot descend all the way to the phantom-line positions 20' of FIG. 2, i.e., the grippers oppose further downward movement of the motion transmitting member 24 whereby the motion transmitting member 25 continues to move downwardly relative to the member 24 and moves its contact 38 downwardly and away from the contact 37. The circuit of the motor 13 opens and the cams 15 and 28 are brought to an immediate halt. Movement of the member 25 relative to the member 24 causes the spring 34 to store additional energy because the post 36 on the member 25 moves downwardly in the slot 40 of the member 24 and the post 36 thus moves the lower end portion of the spring 34 away from the upper end portion which is affixed to the post 35 of the member 24. Thus, the safety device including the grippers 20 and the motion transmitting members 24, 25 with their contacts 37, 38 has completed the job of arresting the motor 13 before the grippers 20 and/or the ram 10 could injure the finger or fingers of the operator if the obstacle in the space between the lines 47 and 49 is indeed constituted by one or more fingers.

When the obstacle is removed from the space between the grippers 20 and the platform 50, the spring 34 is again free to contract and to move the motion transmitting member 24 relative to the motion transmitting member 25 in a direction to increase the distance between the roller follower 26 and the grippers 20, i.e., to move the grippers 20 all the way to the phantom-line positions 20' of FIG. 2. This causes the post 35 to return into the lowermost portion of the adjacent slot 39 and the slot 40 again receives the post 36 in its upper end portion. The contacts 37, 38 of the safety switch complete the circuit of the motor 13 and the shaft 16 is set in motion to proceed with rotation of the cams 15 and 28 in the direction which is indicated by the arrows 31.

Figure 5:
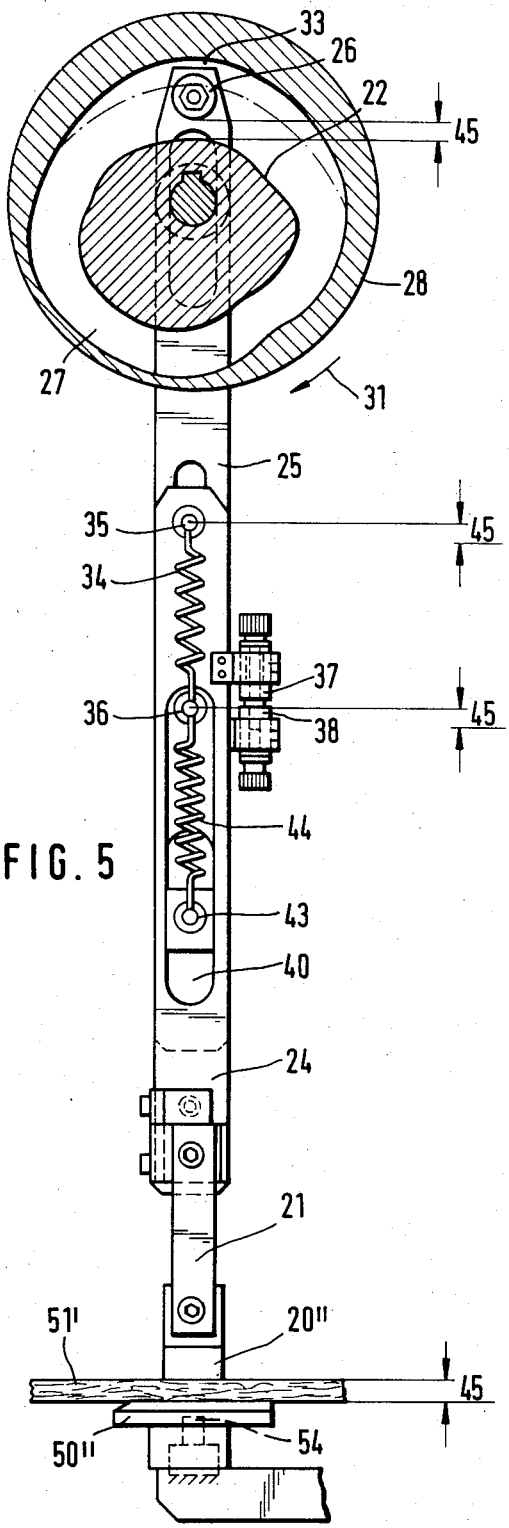
FIG. 5 illustrates the structure of FIG. 4 but with the work engaging device in contact with a workpiece which is thicker than that shown in FIG. 4.
Figure 4:
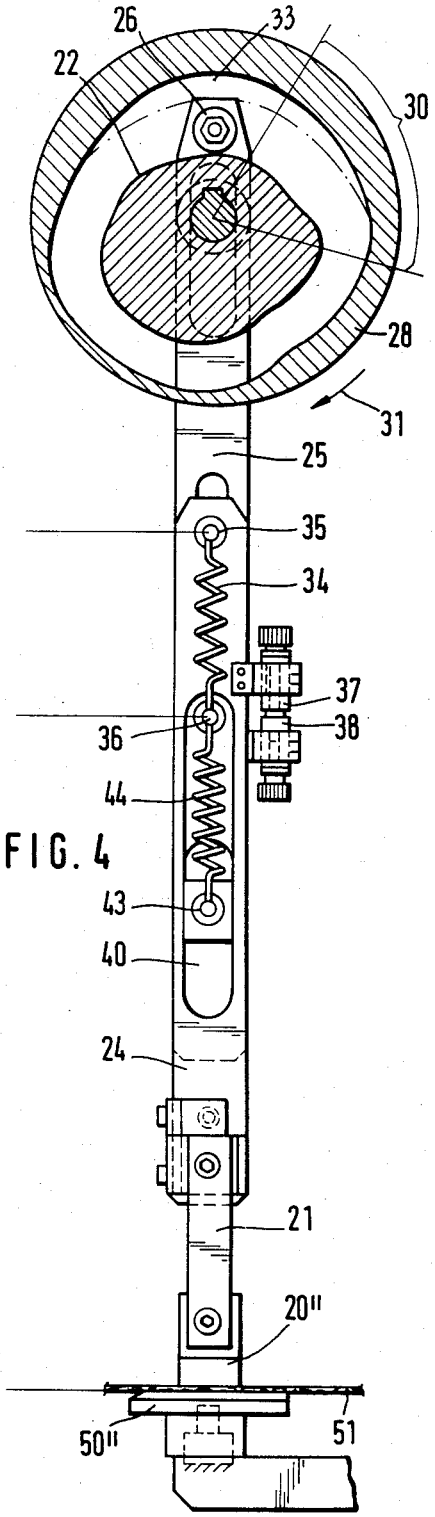
FIG. 4 illustrates the structure of FIG. 2 but with the driven cam in a different angular position.

The roller follower 26 then enters the next portion of the groove 27 including the crescent-shaped recess 33 in the outer surface 23, and the configuration of the corresponding portion of the inner surface 22 (which is tracked by the roller follower 26 under the action of the spring 44) is such that the roller follower 26 moves nearer to the axis of the shaft 16 and thereby moves the grippers 20 (via motion transmitting members 24, 25) downwardly from the positions 20' to the phantomline positions 20'' (see FIGS. 4 and 5). The exact level of the phantom-line positions 20″ of the grippers 20 depends upon the thickness of the workpiece (51 or 51′) which is disposed in the space between the platform 50 and the grippers 20. The locking means for the platform 50 is rendered inoperative (e.g., by a proximity switch, not shown) when the grippers 20 leave the positions 20′ so that the platform 50 is then maintained in the upper end position of abutment with one or more stops on or of the frame 100 solely under the action of the coil spring or springs 56. Thus, the grippers 20 can proceed to move the platform 50 downwardly to the lower end position in which the top surface 50*a* is located at the level 62 shown in the lower portion of FIG. 2. Such lower end position of the platform 50 is shown in FIGS. 4 and 5, as at 50″. The extent of downward movement of the platform 50 from its upper to its lower end position is indicated at 63. At such time, the platform 50 maintains its top surface 50*a* at a predetermined level (62) with reference to the top surface of the fixedly mounted lower tool 54.

FIGS. 4 and 5 show that, when the grippers 20 reach their lower end positions 20″, the roller follower 26 on the upper motion transmitting member 25 is disposed in that portion of the endless groove 27 which includes the crescent-shaped recess 33 in the outer surface 23, i.e., the recess 33 is then located at a level above the shaft 16 of the motor 13. The component which is held in the socket 59 is then closely or immediately adjacent to the upper side of the workpiece 51 or 51′ and is in proper alignment with the component which rests on the top surface of the stationary tool 54. The bias of the spring or springs 56 for the platform 50 is less pronounced than the bias of the spring 34 so that the spring or springs 56 yield and allow the platform 50 to descend to its lower end position 50″ when the grippers 20 bear upon the upper side of the workpiece 51 or 51′ on their way from the positions 20′ to the positions 20″. The bias of the spring 44 (which ensures that the roller follower 26 normally contacts the inner surface 22 of the cam 28) is also more pronounced than that of the spring or springs 56 which urge the platform 50 to its upper end position.

If the grippers 20 engage a relatively thin or very thin workpiece 51, the spring 44 continues to maintain the roller follower 26 in contact with the inner surface 22 of the cam 28, even at the time when the crescent-shaped recess 33 is located at a level above the shaft 16 (note FIG. 4), i.e., at the time when the platform 50 is already moved to and held in its lower end position 50″. The distance between the undersides of the grippers 20 and the top surface 50*a* of the platform 50 is then negligible. The contacts 37, 38 engage each other so that the motor 13 is free to rotate the shaft 16 and the cams 15 and 28.

If the thin workpiece 51 of FIG. 4 is replaced with or followed by the much thicker workpiece 51′ of FIG. 5, the lower end positions 20″ of the grippers 20 are not identical with the similarly referenced lower end positions of FIG. 4, i.e., the difference amounts to the difference 45 between the thicknesses of the workpieces 51 and 51′. The lower end position 50″ of the platform 50 shown in FIG. 5 is the same as that in FIG. 4, i.e., the platform has completed its downward movement and cannot yield any more. This causes the spring 44 to yield and to allow the roller follower 26 to move upwardly and away from the inner surface 22 of the cam 28, as clearly shown in the upper portion of FIG. 5, with the result that the combined effective length of the motion transmitting members 24, 25 remains unchanged. Such motion transmitting members have simply shifted their positions relative to those of FIG. 4 by moving jointly upwardly to the extent which is determined by the difference (45) between the thicknesses of the workpieces 51 and 51′. Thus, the underside of the thicker workpiece 51′ shown in FIG. 5 is disposed at the same level (62) as the underside of the much thinner workpiece 51 of FIG. 4 but the upper side of the workpiece 51′ is disposed at a level which deviates from the level of the upper side of the workpiece 51 by the distance 45 shown in the lower portion of FIG. 5. This distance is the same as that between the levels of the axes of the posts 36 in FIGS. 4 and 5 (note the central portion of FIG. 5) as well as between the levels of the axes of the posts 35 shown in FIGS. 4 and 5 (note the upper part of FIG. 5).

The contacts 37, 38 of the safety switch for the motor 13 continue to engage each other in spite of the fact that the level of the lower motion transmitting member 24 in FIG. 5 is above the level of the same member in FIG. 4. This is due to the fact that the distance between the roller follower 26 and the grippers 20 is the same in FIG. 4 as in FIG. 5 because the upward movement of the roller follower 26 above and away from the inner surface 22 in the region of the recess 33 (note FIG. 5) is shared not only by the member 25 but also by the member 24. This, in turn, is due to the fact that the spring 34 is stronger than the spring 44 so that the latter yields as a result of introduction of a thicker workpiece into the space between the platform 50 and the grippers 20. Consequently, introduction of a thicker workpiece 51′ into the space between the grippers 20 and the platform 50 does not result in stoppage of the motor 13 (except, of course, if an obstacle is detected between the upper side of the thicker workpiece 51′ and the undersides of the grippers 20). The extent to which the roller follower 26 is lifted off the inner surface 22 of the cam 28 also matches the distance 45 (note the uppermost portion of FIG. 5). Such movability of the roller follower 26 radially of the cam 28 is rendered possible by the provision of the recess 33 in the outer surface 23.

The just discussed feature renders it possible to randomly treat relatively thin, relatively thick and medium thick workpieces in any desired sequence. The spring 44 ensures that the difference between the thicknesses of successively treated workpieces is accounted for in a fully automatic way, and the depth of the recess 33 can be readily selected with a view to ensure that the machine can properly apply components of articles of hardware to workpieces whose thickness can vary within a desired practical range. Such versatility of the improved machine is achieved in a very simple and inexpensive way, i.e., by the expedient of providing the spring 44 which urges the roller follower 26 against the inner surface 22 of the cam 28 and by the provision of the recess 33 which enables the roller follower 26 to move away from the inner surface 22 while the grippers 20 bear against the upper side of a relatively thick workpiece, such as the workpiece 51′ of FIG. 5.

Referring again to FIG. 2, the maximum stroke of the grippers 20 between the level (46) of their undersides in the upper end position of the motion transmitting member 24 and the level (62) of their undersides when they engage an extremely thin workpiece or when no workpiece is located between the grippers and the platform 50 is shown at 64. Thus, the grippers 20 move all the way between the levels 46 and 62 only when the workpiece 51 is thin or when the workpiece is absent. If the workpiece is thicker, the grippers 20 descend from the level 46 to an intermediate level which is located somewhere between the levels 46 and 62, i.e., the distance 64 is reduced by the difference between the thickness of the removed workpiece and the thickness of the freshly inserted workpiece. At the time the ram 10 is ready to contact a component in the socket 59 of the grippers 20, the distance between such component in the socket 59 and the upper side of a relatively thick or a relatively thin workpiece is the same because the distance between the socket 59 and the undersides of the grippers 20 is constant and the undersides of the grippers 20 are always in contact with or immediately adjacent to the upper side of a thick or thin workpiece at the time when the ram 10 completes the last stage of its downward stroke to effect expulsion of the component from the socket 59 and the application of such component to the workpiece as well as to the component on the lower tool 54.

The movements of the ram 10 are out of phase with movements of the grippers 20. The tip of the ram 10 is caused to descend while the grippers 20 are held in the positions 20'' of FIG. 4 or 5 and to thus expel the component from the socket 59. Such expulsion is facilitated by the fact that the connection between the head 121 and the grippers 20 comprises leaf springs 21 which enable the grippers to yield so that the expelled component can be moved against the upper side of the workpiece 51 or 51' on the top surface 50*a* of the platform 50 (which latter is then held in the lower end position 50'' of FIG. 4 or 5). As mentioned above, the component in the socket 59 can comprise a portion of a rivet having a head and a downwardly extending shank which latter penetrates through the material of the workpiece 51 or 51' and enters the opening of a washer or cap on the lower tool 54.

When the application of the two components to the workpiece 51 or 51' and their attachment to each other is completed, the cam 15 cooperates with the spring 17 to lift the ram 10 simultaneously with upward movement of the grippers 20 under the action of the cam 28. At such time, the rate or extent of upward movement of the ram 10 can match or approximate that of the upward movement of the grippers 20. This is determined by the configuration of the peripheral surface of the cam 15 and by the configuration of the inner surface 22 of the cam 28. At any rate, the ram 10 reaches its upper end position when the cam 15 completes a full revolution, and the grippers 20 reach their upper end positions not later than at such time because the cams 15 and 28 rotate in unison through identical angles. In the illustrated embodiment, the roller follower 26 ceases to have radial play with reference to the cam 28 as soon as the portion 30 of the groove 27 advances beyond this follower (as considered in the direction of arrow 31 shown in FIG. 2), i.e., the roller follower 26 is then form-lockingly connected with the cam 28 and the rate of its movement to the upper end position shown in FIG. 2 cannot deviate from the rate which is determined by the corresponding portion of the inner surface 22. A comparisoin between that portion of the peripheral surface of the cam 15 which controls the follower 14 during the last stage of movement of the ram 10 to its upper end position with that portion of the groove 27 in the cam 28 which determines the last stage of upward movement of the grippers 20 to their upper end positions will reveal that the ram 10 is lifted more rapidly. Nevertheless, the grippers 20 reach their upper end positions (note the line 46 in the lower portion of FIG. 2) ahead of the ram 10 because the radius of curvature of the last portion of the groove 27 (to the right of the roller follower 26 in FIG. 2) is located on the axis of the shaft 14.

The socket 59 is again in the range of the aforementioned pusher (which delivers discrete components from the discharge end of the chute 57 to the socket 59) as soon as the grippers 20 reassume their upper end positions so that the socket 59 can receive a fresh component which is thereupon attached to the same workpiece 51 or 51' or to a freshly inserted workpiece. Also, and since the platform 50 has reassumed its upper end position under the action of the coil spring or springs 56, the pusher which cooperates with the chute 60 can deliver a fresh component into the passage 52 above the lower tool 54. This completes the preparation for the next working cycle which can begin as soon as the attendant actuates a suitable starting device, e.g., a foot pedal which closes a switch in series with the switch including the contacts 37 and 38.

An important advantage of the improved machine is the simplicity of the means (cam 28 and spring 44) which enables the machine to treat workpieces having different thicknesses. The versatility of the improved machine (within practical limits) can be enhanced by increasing the depth of the recess 33 so that the machine can handle relatively or very thin workpieces (51) as well as workpieces whose thickness appreciably exceeds that of the workpiece 51'. As mentioned avove, the material of the workpiece 51' can be the same as that of the workpiece 51 except that the workpiece 51' contains two or more layers each of which corresponds to the workpiece 51. Of course, each workpiece can consist of a single stratum (even a very thick workpiece) or each workpiece (even the thinnest one) can consist of two or more layers which may but need not adhere to each other in the region where they overlie the top surface 50*a* of the platform 50.

Another important advantage of the improved machine is that the provision of means for allowing treatment of thick or thin workpieces does not affect the operation of the safety device, i.e., the contacts 37, 38 of the safety switch remain in engagement with one another when a relatively thin workpiece (such as 51) is followed by a much thicker workpiece (such as 51') or vice versa because this does not necessitate any changes in the positions of the motion transmitting members 24, 25 relative to each other but rather a joint displacement of the members 24, 25 radially of the cam 28. The safety switch including the contacts 37, 38 opens only when an obstruction other than a workpiece is placed between the grippers 20 (which constitute the sensors of the safety device) and the upper side of the workpiece, i.e., when the combined height of the workpiece and one or more obstructions is such that the grippers 20 cannot descend to the positions 20' of FIG. 2. In other words, the safety device can discriminate between an acceptable obstacle which is constituted by a relatively thick workpiece and an unacceptable obstacle which is constituted by one or more fingers alone or by a thick or thin workpiece plus one or more fingers or other objects that interfere with the movement of the grippers 20 from their upper end positions to the positions 20'. This is due to the configuration of the groove 27 which compels the grippers 20 to cover a first distance (between the solid-line positions and the phantom-line positions of FIG. 2) in the absence of an obstacle in the space between the grippers and the workpiece but which thereupon allows the motion transmitting members 24, 25 to move jointly relative to the cam 28 in order to compensate for the difference between the thicknesses of successively treated workpieces. In other words, the provision of the recess 33 becomes of importance only after the safety device has already completed the monitoring of the space between the workpiece and the grippers.

In its simplest form, the improved arrangement which compensates for differences between the thicknesses of successively treated workpieces could operate without the coil spring 44 by relying on the weight of the motion transmitting members 24, 25 for the purpose of maintaining the roller follower 26 in contact with the inner surface 22 of the cam 28. The provision of the spring 44 is desirable and advantageous because such spring eliminates or reduces the likelihood of accidental retention of the roller follower 26 in a position other than that of contact with the inner surface 22 at a time when separation of the roller follower from the surface 22 is not dictated by the thickness of the workpiece between the grippers and the platform.

The extent of movement of the motion transmitting members 24, 25 relative to each other can be selected by appropriate selection of the length of the slot 39. The feature that the spring 44 is weaker than the spring 34 ensures that the safety switch including the contacts 37, 38 remains closed when the introduction of a relatively thick workpiece compels the spring 44 to yield and to allow the roller follower 26 to move away from the inner surface 22 of the cam 28.

As mentioned above, the platform 50 is preferably locked in its upper end position (to which the platform is urged by the coil spring or springs 56) during placing of a selected portion of a workpiece onto the top surface 50*a* into register with the passage 52. This simplifies the manipulation of the workpiece. The locking means is released after the grippers 20 leave their upper end positions, namely when the scanning of the space between the inserted workpiece and the grippers 20 is already completed and preferably at a time when the grippers already contact the upper side of a relatively thick workpiece. As also mentioned above, the bias of the spring or springs 56 is weaker than that of the spring 34 which latter normally maintains the safety switch including the contacts 37, 38 in closed position; this is desirable and advantageous because the likelihood of accidental opening of the safety switch and of resulting stoppage of the motor 13 is greatly reduced or eliminated, i.e., the platform 50 can yield against the opposition of the spring or springs 56 and can move downwardly in order to avoid any movement of the motion transmitting members 24, 25 relative to each other except when such relative movement is necessary in order to avoid injury to a careless or inexperienced operator. However, it is presently preferred that the lower end position 50″ of the platform 50 be invariably the same because this ensures that the component in the passage 52 on the top surface of the lower tool 54 is always disposed at an optimum distance from the underside of a thick or thin workpiece at the time when the ram 10 is about to complete the last stage of its downward movement in order to attach the upper component to the workpiece, to simultaneously attach the upper component to the lower component, and to simultaneously attach at least one of these components to the workpiece therebetween.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine for applying components of articles of hardware or the like to sheet- or web-like workpieces, the combination of a first tool; a second tool movable toward said first tool from a retracted position in which said tools define a space for a workpiece therebetween; first drive means for reciprocating said second tool from and back to said retracted position; means for releasably holding a component between the workpiece in said space and said second tool, said holding means being movable with and relative to said second tool between a first position remote from and a plurality of second positions nearer to said first tool; and second drive means for moving said holding means between said positions, including a rotary cam defining an endless path, a first reciprocable motion transmitting member having a follower extending into said path, a second motion transmitting member connected with said holding means, means for coupling said members to each other with limited freedom of movement, means for yieldably biasing said members in directions to increase the distance between said follower and said holding means, a prime mover operable to rotate said cam, and a device for preventing the operation of said prime mover in response to movement of one of said members relative to the other of said members against the opposition of said biasing means when said holding means encounters an obstacle on its way from the first to a second position, said path having a portion which allows said follower to move radially of said cam in that angular position of the cam in which said holding means is at least close to a second position.

2. The combination of claim 1, wherein said prime mover includes an electric motor and said device includes an electric switch which is in circuit with said motor and is closed when said biasing means is free to maintain said follower at a maximum distance from said holding means.

3. The combination of claim 1, wherein said cam includes an endless groove which constitutes said path and said cam further includes two surfaces flanking said groove, said surfaces being generally equidistant from one another save for those portions thereof which flank said portion of said path.

4. The combination of claim 3, wherein said surfaces include an endless inner surface and an endless outer surface and said cam has a recess provided in said outer surface in the region of said portion of said path.

5. The combination of claim 1, wherein said coupling means includes means for limiting the extent of movement of said members relative to one another.

6. The combination of claim 5, further comprising means for yieldably urging said first member in a sense to move said first member in a direction toward said first tool.

7. The combination of claim 1, further comprising work supporting means adjacent to said first tool and movable between retracted and extended positions in which said supporting means is respectively more distant from and nearer to said second tool, and resilient means for yieldably urging said supporting means to said extended position, the force of said biasing means exceeding that of said resilient means so that said holding means can move said supporting means from said extended to said retracted position when said holding means moves to a second position.

8. The combination of claim 7, wherein said supporting means includes a platform having a work-supporting surface provided with a passage for said first tool.

9. The combination of claim 8, further comprising means for arresting said platform in said extended position against movement beyond such position and/or against movement back to said retracted position.

10. The combination of claim 1, further comprising resilient means for urging said first member in a direction toward said first tool with a force which is weaker than the force of said biasing means.

11. The combination of claim 10, wherein at least one of said resilient means and said biasing means comprises a coil spring.

12. The combination of claim 1 wherein said holding means includes a plurality of grippers defining a socket for a component of an article of hardware and being arranged to bear against the workpiece in said space in a second position of said holding means.

13. The combination of claim 1, wherein said first tool is stationary and is disposed at a level below said second tool.

14. The combination of claim 1, wherein said first drive means receives motion from said prime mover.

15. The combination of claim 14, wherein said first drive means comprises a second rotary cam and said prime mover includes an output shaft which is connected to and drives said cams.

16. The combination of claim 1, wherein said cam has a side face and an endless cam groove constituting said path and provided in said side face.

17. The combination of claim 1, wherein said members are elongated parallel bars.

* * * * *